US005504721A

United States Patent [19]

Calabrese

[11] Patent Number: 5,504,721

[45] Date of Patent: Apr. 2, 1996

[54] CORRECTION MECHANISM

[75] Inventor: Vincent Calabrese, Lausanne, Switzerland

[73] Assignee: Montres Universal S.A., Thonex-Geneve, Switzerland

[21] Appl. No.: 390,990

[22] Filed: Feb. 21, 1995

[30] Foreign Application Priority Data

Feb. 21, 1994 [CH] Switzerland ..... 0499/94

[51] Int. Cl.[6] ..... G04B 18/00; G04B 27/02

[52] U.S. Cl. ..... 368/185; 368/190; 368/196

[58] Field of Search ..... 368/76, 80, 185, 368/190, 195, 196–199

[56] References Cited

U.S. PATENT DOCUMENTS 1,419,029 6/1922 Doll .

FOREIGN PATENT DOCUMENTS

0504623A1 9/1992 European Pat. Off. .
351223 7/1958 France .
462046 7/1966 France .

*Primary Examiner*—Vit W. Miska
*Attorney, Agent, or Firm*—Kane, Dalsimer, Sullivan, Kurucz, Levy, Eisele and Richard

[57] ABSTRACT

Correction mechanism consisting of a corrector (K) mounted so as to pivot (1) and provided with a roller-pin (P) pressing against a rod (T) under the action of a spring (Kr). The rod (T) has two parts (Ta, Tb) of different diameters. When the roller-pin (P) is pressed against the large-diameter part (Ta), the corrector (K) is moved away from the wheel (R2) to be blocked or to be driven. A pull on the rod (T) enables the roller-pin (P) to move onto the smaller-diameter part (Tb), this having the effect of causing the corrector (K) to work in a negative manner. Such a corrector is advantageously used by itself or with a similar corrector in a double-faced watch.

2 Claims, 3 Drawing Sheets

CORRECTION MECHANISM

FIELD OF THE INVENTION

The subject of the present invention is a mechanism making it possible to add an additional dial on the reverse side of watches so as to obtain a double-faced watch.

Numerous constructions of so-called double-faced watches have been known for a long time, but the real difficulty in use lies in the winding and setting of the time on both faces.

It is possible to provide, on a movement constructed expressly for a double-faced watch, a winding-crown having several positions, but in the case of existing movements, the original crown continues to fulfil perfectly the winding function, whereas, for setting the time, it can act only on the side provided, thus requiring an additional means to be added for setting the time on the added side.

PRIOR ART

Referring to the Swiss Patent No. 57,805 which describes, using a movement with a central center-wheel, a very simple and reliable means for obtaining a double-faced watch, it is noted that there was no provision for offsetting the two displays.

The Swiss Patent No. 7,594, using an offcentered center-wheel, describes a means which is just as simple and reliable for obtaining a good result and there is provision for a means for offsetting the two displays by the means of two push-pins.

For mechanical watches, various correctors are known which can fulfil this role.

The first, a rotary one, is the conventional crown; it permits rapid correction but requires many components and therefore takes up a lot of space.

The second, an axial one, is the old push-pin; this requires few components but has the disadvantage of having to employ a suitable tool for correcting, and in addition the contact of the correcting part with the gear train is abrupt and may cause damage.

The third, an axial one, is the push-button; few components and easy to correct, but disadvantageous by reason of the high risk of being pushed unintentionally, as well as being an abrupt contact.

The fourth, an axial one, is the bolt; few components but difficult to use and to seal, and an abrupt contact.

SUMMARY OF THE INVENTION

The present invention, whose object is to produce double-faced watches on existing movements, and to do so with the greatest ease of use for the consumer, and taking into account the two aforementioned patents which already permit this, proposes a mechanism, capable by dint of its simplicity and therefore its reliability, of producing these watches without increasing their thicknesses in an exaggerated way and with easy, reliable and durable correction.

This result is achieved by the mechanism of the invention, by virtue of a novel type of corrector which, acting in a negative way under the impulse of an elastic force, combines the advantages of the various aforementioned means without entailing their drawbacks.

By way of example, its application has been developed on a movement with a central center-wheel, according to U.S. Pat. No. 57,805, but its operation may equally well be provided on a movement with an offcentered or additional center-wheel.

In order to avoid machining operations on the basic movement, the movement is simply locked in a caging ring M, by appropriate and robust means so that they form an entity and all the additional components are housed on an additional plate N which is fixed onto the caging ring.

BRIEF DESCRIPTION OF THE DRAWINGS

The appended drawings depict, by way of example, one embodiment of the invention.

DESCRIPTION OF TEE PREFERRED EMBODIMENT

Figure 1:
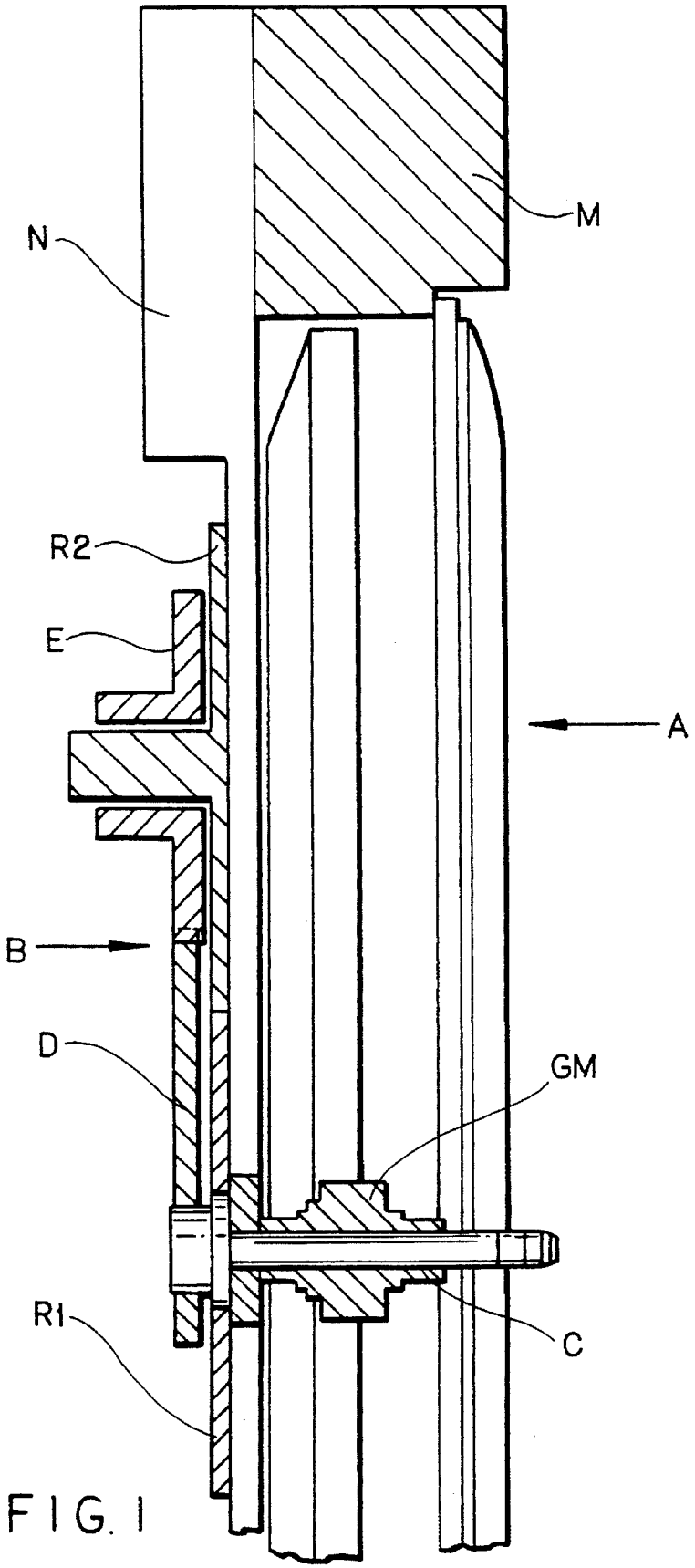
FIG. 1 depicts a section of the fixing system as well as the transmission of the movement from one face to the other.

In the present case, the additional display on the reverse side B is offcentered in order to enable its indicators to rotate in the direction of advancing time without having to employ an additional setting-wheel and so as also to avoid the use of the minute-wheel in having recourse to a display of the hours in a jumping way.

For this purpose, a set-hands-arbor C, elastically fitted into the center-wheel CW, is, on the side B, fastened to a toothed wheel R1 having the same diameter as the minute-wheel R2 and fastened to a finger D which causes a star-wheel E indicating the jumping hours to jump every hour, whereas, on the side A, it possesses a conical part intended for the indenting of the traditional cannon-pinion, not depicted in the drawing.

Since the minute-runners on the side A are conventional, they are not depicted in the drawing.

A rod T, pivoted radially in a caging ring M, moves horizontally and can occupy two or more positions which can be controlled by a fastened crown, not depicted in the drawing, housed outside the case. The means for positioning this rod are not depicted.

This rod T possesses cylindrical parts Ta, Tb of different diameters connected via a conical part Tc. A corrector K, pivoted axially at 1, in the caging ring M, or in a top plate N, includes a roller-pin P which bears against the rod T, and the corrector is provided with an elastic arm Kr pressing against a stud F and having the function of a spring.

Figure 2:
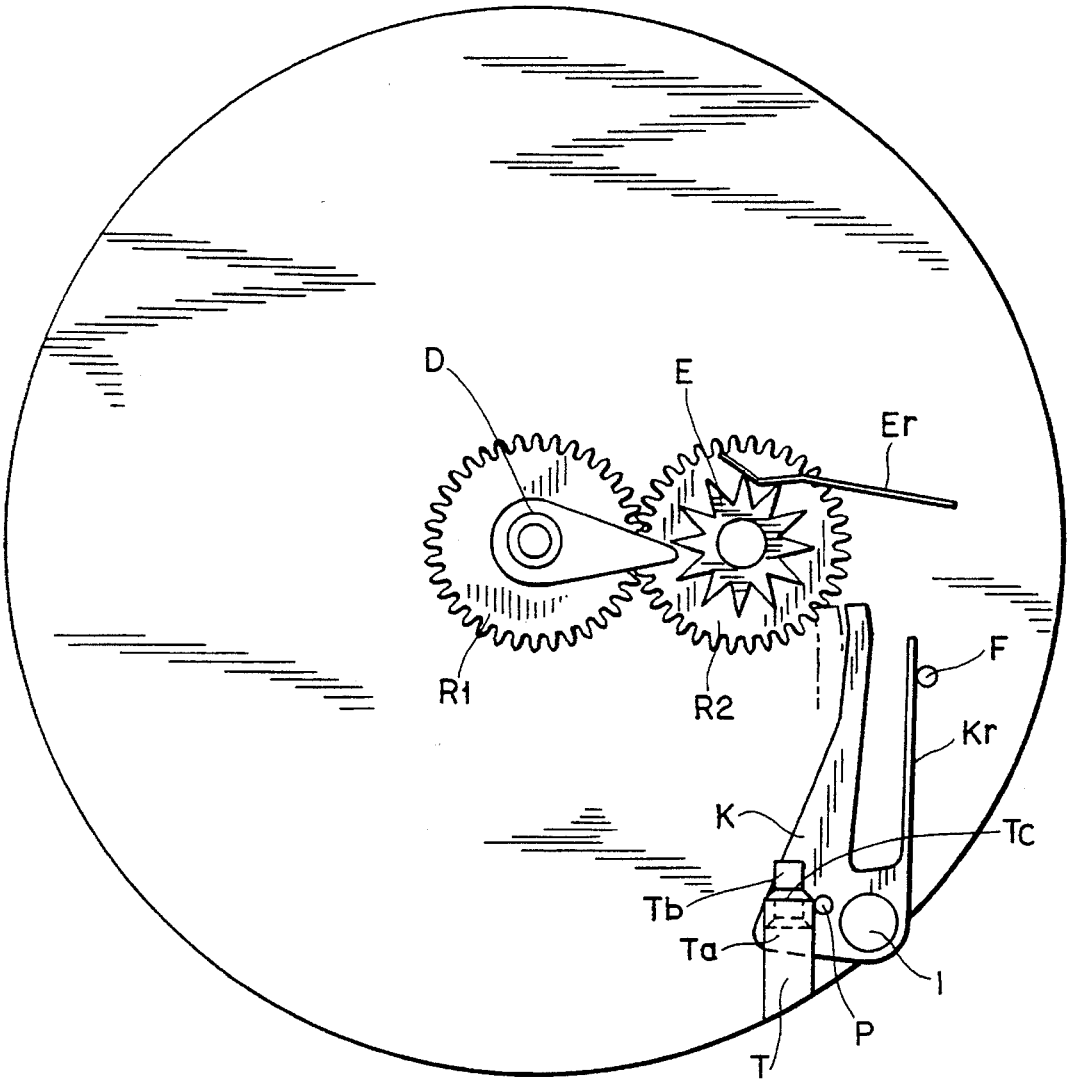
FIG. 2 depicts a view, from the side B, of the additional components serving for the display, as well as of the corrector forming the subject of the present invention.

The position depicted in FIG. 2 corresponds to that of normal operation, when the crown controlling the rod T is held against the case.

In this position, despite the thrust of the spring Kr, the roller-pin P remains pressed against the large-diameter part of the rod T and holds the corrector K in the position of no contact with a toothed wheel R2. The transmission between the two displays A and B can come into perfect synchronism through the agency of the toggle-pin C, nothing preventing this transmission.

When, by pulling on the crown fastened to the rod T, it is caused to adopt the position depicted by the dotted lines, the roller-pin P, under the thrust of the spring Kr, slides over the conical part Tc and ends up bearing on the smaller-diameter cylindrical part Tb, thus releasing the corrector K which, under the influence of the spring Kr, will end up with its tip received in the toothing of the wheel R2. This blocking is absolutely independent of the forcefulness of the external operation, and its penetration force is solely related to the force of the spring Kr and to the shape of its tip; this contact, while still being gentle, remains reliable and effective, and it prevents violent or unintentional operation.

By dint of this system, double-faced watches can easily be operated by means of the traditional crown for winding and simultaneously setting the time on both faces, whereas, when it is desired to operate just the face A, the additional crown on the rod T is pulled, and the operation of the display B is blocked.

The simplicity of this mechanism, which has the advantage of the security of the lock and of the ease of manipulating the crown, while still avoiding abrupt or unintentional contact of the pusher, is composed of only two additional components T and K having simple, and therefore reliable, functions.

Figure 3:
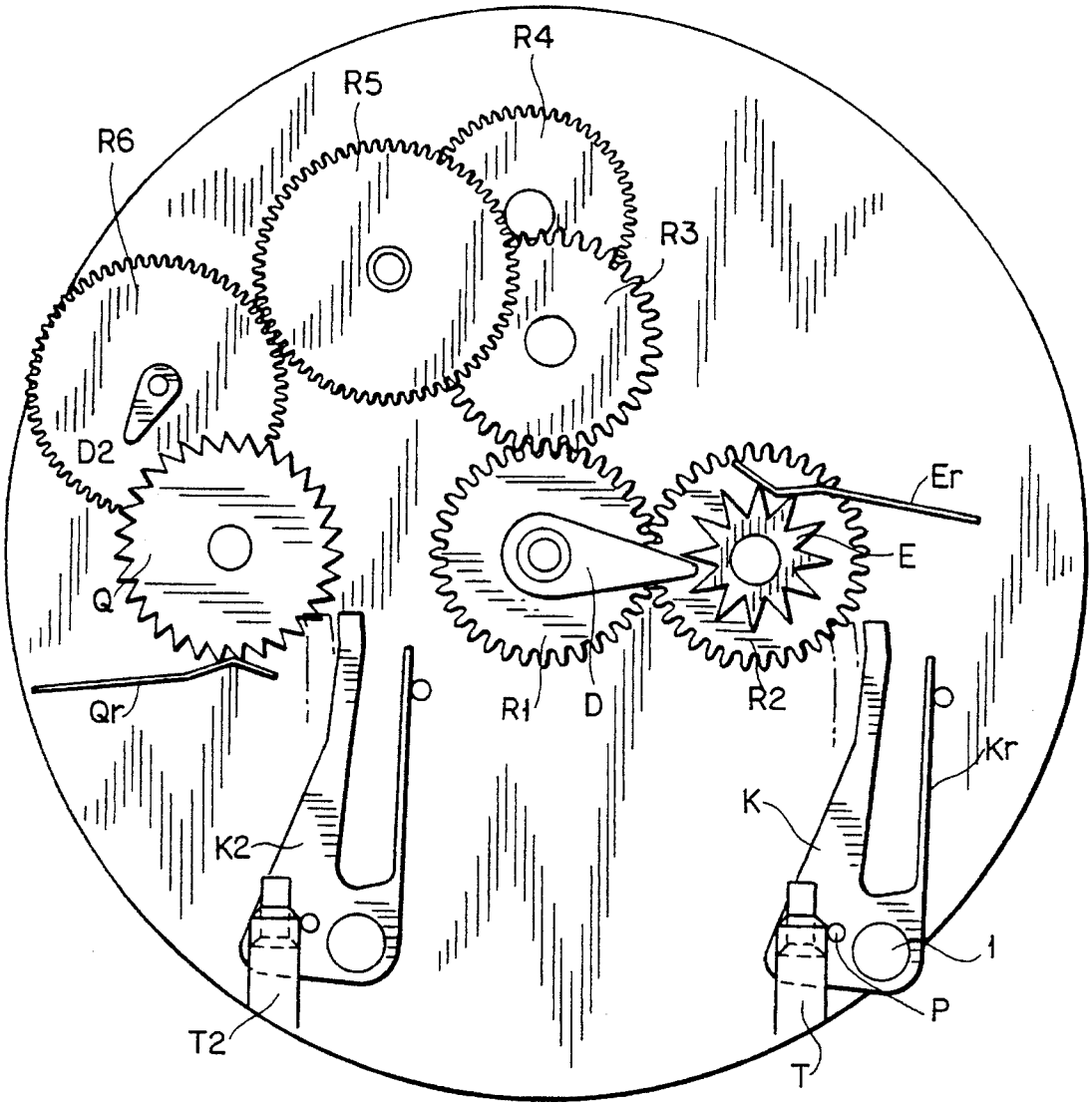
FIG. 3 depicts another embodiment of the invention.

Another advantage of this system lies in the fact that, since it does not occupy much space, it allows additional mechanisms to be added, as in the example shown in FIG. 3.

The wheel R3, revolving in the same plane as the wheels R1 and R2, has the same diameter and therefore rotates at the same speed of one revolution per hour. R3, via a wheel R4, drives a wheel R5 which makes one revolution in 24 hours.

R5, rotating in the direction of advancing time, carries a 24-hour or day/night display index and, by virtue of the wheel R6 carrying a finger D2, communicates the rotation in the direction of advancing time to the 31-toothed star-wheel Q, which indicates the date. It is clearly possible to add a second corrector K2, identical to the corrector K1, completely independent of the other functions and serving solely for rapidly setting the date. The advantage of the function of this corrector is in this specific case largely demonstrated. Indeed, if it is manipulated at midnight, when the date is in the process of changing, the force of its spring will not allow it to cause any damage, while it will be easy enough to overcome the resistance of the spring Qr of the star-wheel, when correction is possible, and thus to advance the star-wheel Q by one tooth with each pull.

I claim:

1. A correction mechanism for watch movements comprising:

a manually movable rod which is able to axially move from a first axial position to a second axial position and which has a first cylindrical part having a first diameter and a second cylindrical part having a second diameter where the second diameter is smaller than the first diameter;

a rotationally mounted correcting arm which has a protruding roller-pin stud which presses against the rod;

a spring biasing means which maintains the roller-pin pressed against the rod;

a toothed wheel to be driven or blocked by an end of said correcting arm;

wherein when the rod occupies its first position, said roller-pin is pressed against the first cylindrical part of the rod and said end of the correcting arm is spaced away from the toothed wheel and when the roller-pin occupies its second position, said stud is pressed against the second cylindrical part of the rod and said end of the correcting arm engages the teeth of the toothed wheel.

2. A correction mechanism as claimed in claim 1, wherein the spring biasing means consists of an elastic arm which is integral with the correcting arm and which leans against a fixed stud.

* * * * *